US006056524A

United States Patent [19]

Williams et al.

[11] Patent Number: 6,056,524

[45] Date of Patent: May 2, 2000

[54] SCROLL COMPRESSOR ASSEMBLY

[75] Inventors: John R. Williams; Gene M. Fields, both of Arkadelphia, Ark.; Joe T. Hill, Bristol, Va.

[73] Assignee: Scroll Technologies, Arkadelphia, Ark.

[21] Appl. No.: 08/989,988

[22] Filed: Dec. 12, 1997

[51] Int. Cl.[7] ..... F01C 1/02

[52] U.S. Cl. ..... 418/55.1; 418/55.4

[58] Field of Search ..... 418/55.1, 55.4

[56] References Cited

U.S. PATENT DOCUMENTS

| | | | |
|---|---|---|---|
| 3,884,599 | 5/1975 | Young et al. | 418/55 |
| 4,522,575 | 6/1985 | Tischer et al. | 418/55 |
| 4,609,334 | 9/1986 | Muir et al. | 418/55 |
| 4,696,630 | 9/1987 | Sakata et al. | 418/55 |
| 5,064,356 | 11/1991 | Horn | 417/410 |
| 5,427,511 | 6/1995 | Caillat et al. | 418/55.1 |
| 5,551,851 | 9/1996 | Williams et al. | 418/55.1 |
| 5,557,845 | 9/1996 | Burkett et al. | 418/55.1 |

FOREIGN PATENT DOCUMENTS

| | | |
|---|---|---|
| 54-124310 | 9/1979 | Japan . |
| 63-268995 | 11/1988 | Japan . |
| 2-163486 | 6/1990 | Japan . |
| 4-132890 | 5/1992 | Japan . |

*Primary Examiner*—Hoang Nguyen
*Attorney, Agent, or Firm*—Howard & Howard

[57] ABSTRACT

A scroll compressor housing has a center shell having an upper end defining an opening, and a top cap covering the opening and secured to the center shell. A crankcase is positioned within the housing. An orbiting scroll has a base plate and a spiral wrap extending axially from the orbiting scroll base plate. A fixed scroll has a base plate and a spiral wrap extending axially from the fixed scroll base plate nested with the spiral wrap of the orbiting scroll. A riser extends axially upwardly from the crankcase to provide a support surface for the fixed scroll. A radially extending flange on the crankcase is supported by an upper edge of the center shell and the fixed scroll is pinned between the top cap and the center shell. A fixed scroll seal sealingly engages the fixed scroll and the top cap to form a muffler chamber. A rabbet on the fixed scroll matingly engages a shoulder on the crankcase in order to fixedly align the fixed scroll and the crankcase.

45 Claims, 3 Drawing Sheets

SCROLL COMPRESSOR ASSEMBLY

INTRODUCTION

The present invention is directed to scroll type machines, e.g., scroll compressors, and, more particularly, to a scroll type machine having an improved assembly.

BACKGROUND

Scroll machines, such as scroll compressors using a fixed scroll and an orbiting scroll housed within a compressor shell, are well known in the industry. Each of the scrolls of a scroll compressor has a spiral wrap extending axially from a base plate. The spiral wraps nest with one another to form pockets of varying volume. A fluid introduced at a low pressure into a pocket is compressed by the cooperating movement of the spiral wraps progressively decreasing the volume of the pocket. The compressed gas is discharged from a high pressure area proximate the center of the wraps. The fixed scroll is typically bolted to a crankcase which has a bearing surface upon which the orbiting scroll orbits. A motor drives a crankshaft which in turn drives the orbiting scroll along its orbital path, typically via a compliant bushing, or slider block. A lubricant is typically introduced to the bearing surfaces of the compressor to reduce the friction incurred by the relative movement of the components of the compressor. The various components of the scroll machines must be precisely positioned within the shell in order to properly align the scroll wraps and other mating surfaces, a task which can be difficult to accomplish. In assembly of a typical scroll machine, for example, expensive positioning equipment is used to align the fixed scroll and the crankcase before they are bolted together.

U.S. Pat. No. 4,522,575 to Tischer et al. discloses a radially outer edge of a frame being fixed between upper and lower shells of a scroll type machine. A stationary scroll is housed within the compressor above the frame and is connected only to the frame.

U.S. Pat. No. 5,064,356 to Horn discloses a scroll type machine having a cap welded to a shell with a partition extending transversely below the cap, the cap and partition defining a muffler chamber. The partition must be properly positioned before it is welded in place.

It is an object of the present invention to provide a scroll compressor with an improved assembly which reduces or wholly overcomes some or all of the aforesaid difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide scroll type machines with enhanced assembly of machine components.

In accordance with a first aspect a scroll machine has a housing having a first member having an end surface at an end defining an opening, and a second member, secured to the first member so as to close the opening. A crankcase is positioned within the housing. An orbiting scroll has a base plate and a spiral wrap extending axially from the orbiting scroll base plate. A fixed scroll has a base plate, a spiral wrap extending axially from the fixed scroll base plate and nested with the spiral wrap of the orbiting scroll, and a discharge port. The fixed scroll is pinned between the second housing member and either the first housing member or the crankcase. That is, the fixed scroll is fixed in the proper axial position within the housing by being sandwiched, directly or indirectly, between the second housing member and either the first housing member or the crankcase, preferably between the end of the first housing member and a surface of the second housing member which is remote from the end of the first housing member. Where the fixed scroll is sandwiched indirectly between the two housing members, i.e, another component is interposed between the fixed scroll and a first one of the housing members, then the fixed scroll may also be referred to as being pinned between such other component and the first one of the housing members.

In accordance with another aspect, a scroll machine has a housing having a center shell with an end surface defining an opening, and a top cap secured to the center shell. A crankcase has a scroll mating surface, and an orbiting scroll has a base plate and a spiral wrap extending axially from the orbiting scroll base plate. A primary bearing surface on the crankcase supports the orbiting scroll. A riser is formed on the crankcase radially outward of the primary bearing surface and extending axially above the orbiting scroll base plate. A fixed scroll is pinned between the top cap and the end surface of the center shell and has a base plate, a spiral wrap extending axially from the fixed scroll base plate nested with the spiral wrap of the orbiting scroll, a discharge port, and a crankcase mating surface. The scroll mating surface and the crankcase mating surface matingly engage one another to substantially align the fixed scroll and the crankcase. A fixed scroll seal sealingly engages a surface of the fixed scroll and an inside surface of the top cap to form a muffler chamber in fluid communication with the discharge port of the fixed scroll.

In accordance with another aspect, a boltless scroll machine has a housing having a first member with an end surface defining an opening, and a second member secured to the first member. A crankcase is positioned within the housing. An orbiting scroll has a base plate and a spiral wrap extending axially upwardly from the orbiting scroll base plate. A fixed scroll has a base plate, a spiral wrap extending axially downwardly from the fixed scroll base plate and nested with the spiral wrap of the orbiting scroll, and a discharge port. A radially outwardly extending flange is formed on one of the fixed scroll and the crankcase, and the fixed scroll is pinned between the first and second members.

In accordance with another aspect, a scroll machine has a housing having a center shell with an end surface at an end defining an opening, and a top cap secured to the center shell to close the opening. A crankcase has a scroll mating surface, a primary bearing surface supporting the orbiting scroll, a riser radially outward of the primary bearing surface and extending axially above the orbiting scroll base plate, and a radially outwardly extending flange, the flange being supported by the end surface of the center shell. An orbiting scroll has a base plate and a spiral wrap extending axially from the orbiting scroll base plate. A fixed scroll is pinned between the top cap and the crankcase, having a base plate, a spiral wrap extending axially from the fixed scroll base plate and nested with the spiral wrap of the orbiting scroll, a discharge port, and a crankcase mating surface, the crankcase mating surface matingly engages the scroll mating surface to fixedly align the fixed scroll and the crankcase. A fixed scroll seal sealingly engages a surface of the fixed scroll and an inside surface of the top cap to form a muffler chamber in fluid communication with the discharge port of the fixed scroll.

Substantial advantage is achieved by scroll machines in accordance with the disclosure. In particular, assembly of the various machine components is improved and manufacturing costs can be reduced.

From the foregoing disclosure, it will be readily apparent to those skilled in the art, that is, those who are knowledgeable or experienced in this area of technology, that the present invention provides a significant technological advance. Preferred embodiments of the scroll compressor of the present invention can provide a simple construction offering improved assembly and manufacturing costs over other known systems. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
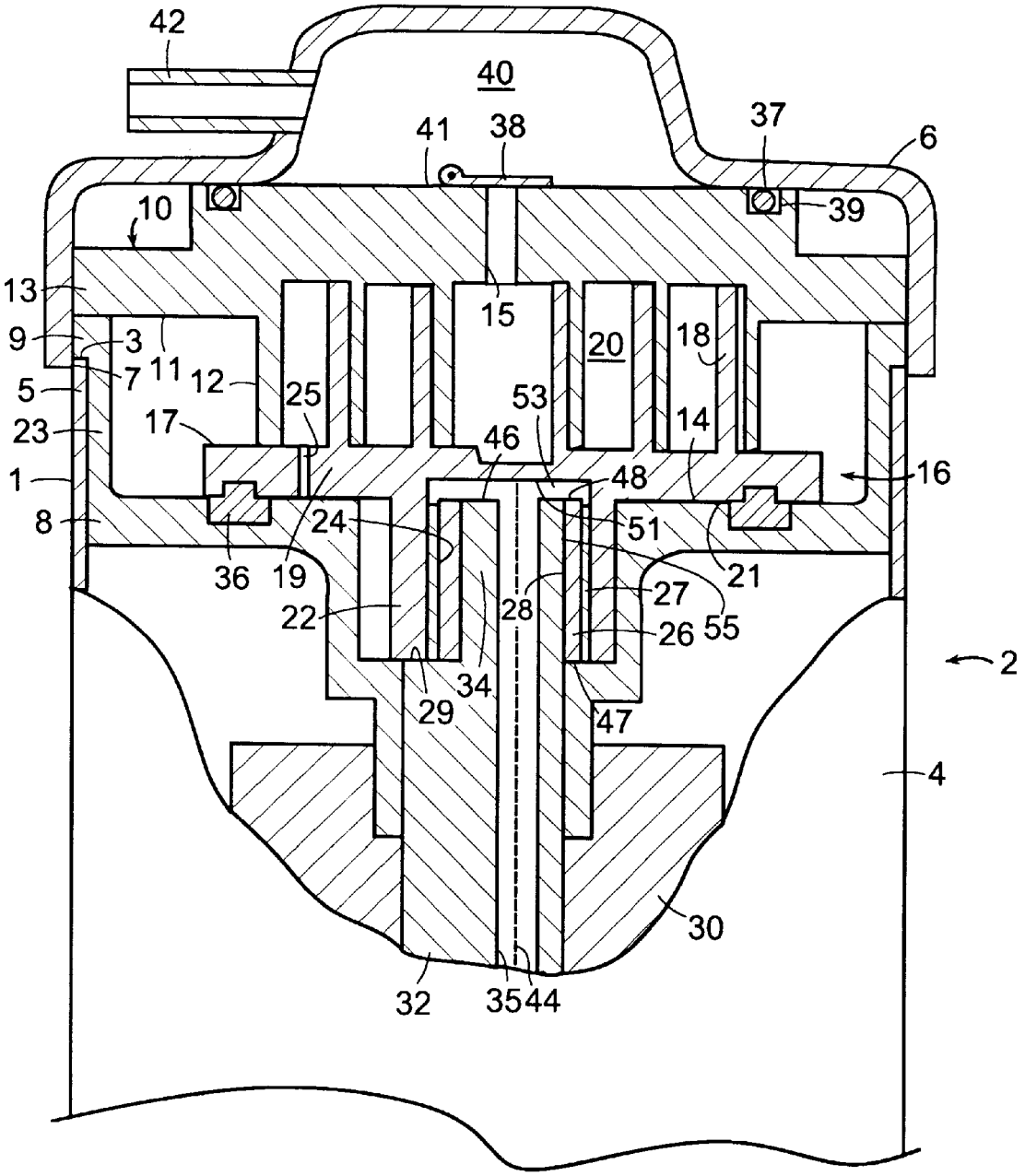
FIG. 1 is a schematic elevation view, shown partially broken away and partially in section of a scroll compressor of the present invention.

The figures referred to above are not necessarily drawn to scale and should be understood to present a simplified representation of the invention, illustrative of the principles involved. Some features of the scroll compressor depicted in the drawings have been enlarged or distorted relative to others to facilitate explanation and understanding. The same reference numbers are used in the drawings for similar or identical components and features shown in various alternative embodiments.

DETAILED DESCRIPTION OF CERTAIN PREFERRED EMBODIMENTS

Scroll type machines comprising fixed and orbiting scrolls are known in the industry for providing various functions. One such scroll type machine is a scroll compressor, used to compress a fluid such as refrigerant. Scroll machines in accordance with the invention will have configurations and components determined, in part, by the intended application and environment in which they are used. For purposes of illustration and description, the following discussion will focus on scroll compressors in accordance with certain preferred embodiments. Those skilled in the art will recognize, however, the ready application of the features and principles disclosed here to other scroll machines. Also, for convenience, the following discussion will use directional terms such as top or upward and bottom, lower or downward to refer to locations or directions for an upstanding scroll compressor design of the type illustrated in FIG. 1 of the appended drawings, unless otherwise clear from the context or from common usage regarding scroll machines.

In a first preferred embodiment, as seen in FIG. 1, scroll compressor 2 comprises a first housing member or center shell 4, preferably substantially cylindrical, having an opening defined by an upper end 5 of center shell 4, and a second housing member or top cap 6 closing off the opening and being secured to the upper end 5 of center shell 4. In the illustrated embodiment, an inner surface 7 of top cap 6 is secured to an outer surface 1 of center shell 4, preferably by welding. Crankcase 8, having a radially outward extending circumferential flange 9 which is supported by an upper end surface 3 at upper end 5 of center shell 4, is housed within center shell 4. In the illustrated embodiment, flange 9 extends circumferentially without interruption or gap around the perimeter of crankcase 8, but may in other preferred embodiments comprise several segments circumferentially spaced about the perimeter of crankcase 8. Fixed scroll 10, having spiral wrap 12 extending axially downwardly from a lower surface 11 of base plate 13, and a bore or discharge port 15 extending axially through a central portion of base plate 13, is supported by crankcase 8. Orbiting scroll 16, having spiral wrap 18 extending axially upwardly from an upper surface 17 of its base plate 19, is positioned between fixed scroll 10 and crankcase 8, with a lower surface 21 of base plate 19 supported by primary bearing surface 14 of crankcase 8. Wraps 12, 18 nest with one another to form discrete pockets 20 between the two scrolls. Hub 22 extends axially downwardly from base plate 19 of orbiting scroll 16, with axially extending central bore 24 formed therein. In other preferred embodiments central bore 24 may be formed at or in a lower surface of an orbiting scroll 16 having no axial hub. A passage 25 is typically formed in orbiting scroll 16, putting lower surface 21 of base plate 19 of orbiting scroll 16 in fluid communication with an area of intermediate pressure of pockets 20, to provide an axial compliance force which biases the tips of spiral wrap 18 against base plate 13 of fixed scroll 10.

Top cap 6 presses downwardly on fixed scroll 10 so that fixed scroll 10 is pinned between top cap 6 and center shell 4. As can be seen, a radially outwardly extending portion, radially outward of the chamber 40, contacts the fixed scroll to pin the fixed scroll as disclosed. As noted above, the term pinned, as used here, refers to a member, such as fixed scroll 10, being axially captured, i.e., fixed in place or immobilized, directly or indirectly, between two other members. Fixed scroll 10 may be in direct contact with top cap 6 and center shell 4 and pinned therebetween, or, as in the illustrated embodiment, be in direct contact with top cap 6 and crankcase 8 so that both fixed scroll 10 and crankcase 8 are pinned between top cap 6 and center shell 4. This eliminates the need in conventional scroll compressor assemblies of fastening fixed scroll 10 to crankcase 8, resulting, in preferred embodiments, in a boltless assembly. Boltless, when used here, refers to an assembly which fixes the fixed scroll and the crankcase to one another without the use of fasteners such as bolts to directly secure one to the other. Preferably in such boltless embodiments, the fixed scroll and crankcase also are boltlessly fixed axially relative to the center shell housing, such as in the embodiment of FIG. 1.

When assembling compressor 2, a preloading axial force is applied, that is, top cap 6 is pressed downwardly in an axial direction pinning fixed scroll 10 and crankcase 8 between top cap 6 and center shell 4. This axial force is applied until top cap 6 is welded to center shell 4. Prestressing the components of compressor 2 with such an axial preloading force helps prevent separation of fixed scroll 10 and crankcase 8 during operation.

In certain preferred embodiments, a resilient member, such as a gasket or O-ring 37, forms a seal between fixed scroll 10 and top cap 6, creating muffler chamber 40.

Preferably such muffler chamber 40 is formed in part by a raised central portion of top cap 6. Annular recess 39 is formed in a discharge, top or upper surface 41 of fixed scroll 10 to receive O-ring 37. A discharge surface here means a substantially planar or curvo-planar exterior surface of the fixed scroll through which discharge port 15 passes. O-ring 37 sealingly engages top cap 6 and discharge surface 41 of fixed scroll 10, and can compensate for minor misalignment of these members with respect to one another.

In preferred embodiments, a raised tower or riser 23 is formed on crankcase 8, radially outward of bearing surface 14, and supports lower surface 11 of fixed scroll 10. The term raised tower or riser, as used here, refers to a member such as a projection extending axially upwardly, providing a supporting surface for the fixed scroll. Such raised tower or riser can extend circumferentially uninterrupted all the way around the perimeter of the crankcase. Alternatively, two or more risers can be circumferentially spaced around the perimeter of the crankcase. Riser 23 preferably extends axially above base plate 19 of orbiting scroll 16, i.e. above upper surface 17 of base plate 19, and more preferably extends more than half the height of spiral wrap 18 of orbiting scroll 16, e.g. substantially to the height of the tips of spiral wrap 18. Flange 9, as discussed above, extends radially outwardly from riser 23, preferably at the top of riser 23 as in the illustrated embodiment. Riser 23 and flange 9 in certain preferred embodiments are unitary with crankcase 8 providing excellent manufacturing and assembly efficiencies. Riser 23 may, in certain preferred embodiments, be comprised of a plurality of axially extending members, each of which extends circumferentially only partially along the outer peripheral edge of crankcase 8. The complex shape of fixed scroll 10 makes it more expensive to manufacture than that of crankcase 8. By extending crankcase 8 upwardly to form riser 23, which meets lower surface 11 of fixed scroll 10, a reduction in the size of more expensive fixed scroll 10 is realized, resulting in significant cost savings. An additional advantage of riser 23 is that it provides a longer contact surface with the interior of center shell 4 which can serve, in certain preferred embodiments, to better assure alignment, and thus a better fit, of crankcase 8 within center shell 4. In preferred embodiments, crankcase 8 can be shrink fit within center shell 4 to facilitate fixturing of crankcase 8 within scroll compressor 2.

Figure 2:
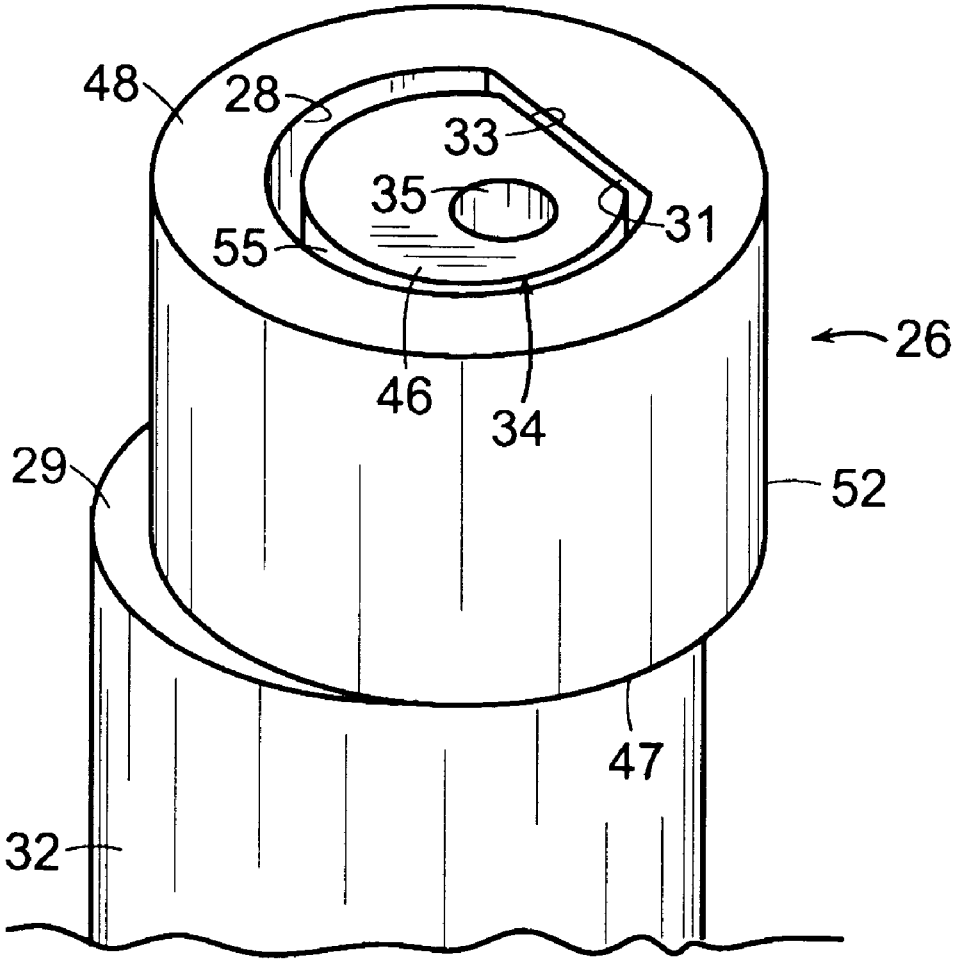
FIG. 2 is a schematic perspective view, shown partially broken away, of the slider block, crankshaft, and eccentric pin of the scroll compressor of FIG. 1.

Slider block 26, best seen in FIG. 2, having pin bore 28 extending therethrough, is received by central bore 24 and rests on shoulder 29 at the top end of crankshaft 32. In certain preferred embodiments, bushing 27 is positioned in central bore 24 concentrically around slider block 26. Motor 30 is housed within center shell 4 and rotatably drives axially extending crankshaft 32. Eccentric pin 34 extends axially from top end 29 of crankshaft 32, having flat drive surface 33 formed thereon and is received by pin bore 28, as seen in FIG. 2. Top surface 46 of eccentric pin 34 is preferably substantially flush with top surface 48 of slider block 26. Alternatively, eccentric pin 34 can have an axial height less than that of slider block 26 above shoulder 29. Lubricant passageway 35 extends axially through crankshaft 32 and eccentric pin 34 for delivery of a lubricant such as oil from a reservoir (not shown) located in a lower portion of compressor 2.

Figure 3:
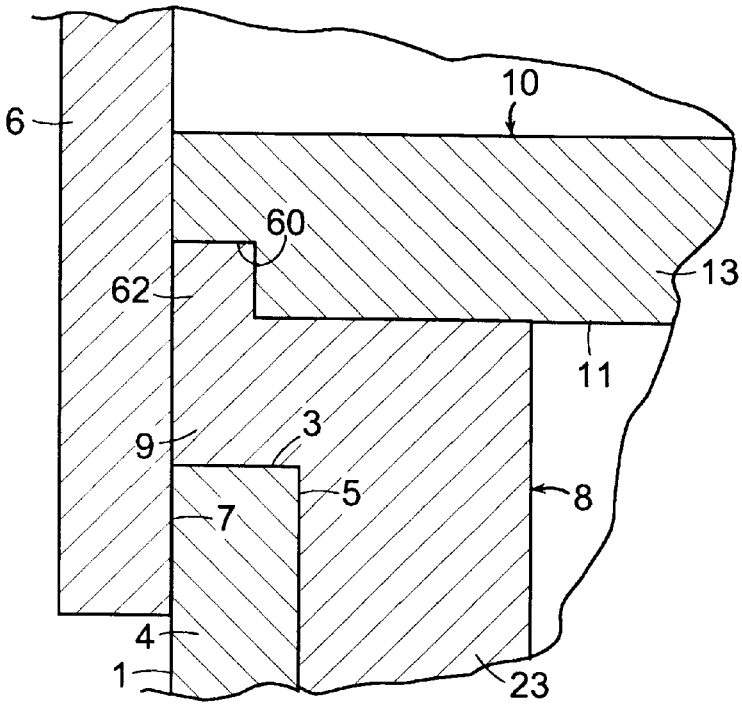
FIG. 3 is a schematic close-up section view of an alternative embodiment of the fixed scroll and the crankcase of the scroll compressor of FIG. 1, shown with a rabbet and ridge, respectively.

Slider block, as used here, refers to an element used in a scroll type machine which transmits forces from an eccentric pin or the like to an orbiting scroll. In certain preferred embodiments, the slider block has a substantially cylindrical shape with a bore extending therethrough, a substantially flat first end or lower surface, and an opposed substantially flat second end or top surface, the first and second surfaces being substantially parallel to one another. Pin bore, as used here, refers to a bore within the slider block which receives an eccentric pin or the like. In the embodiments of FIGS. 1–3 pin bore 28 is an axially extending bore formed in slider block 26 and defines flat driven surface 31, as best seen in FIG. 2. Pin bore 28, in certain preferred embodiments extends through slider block 26 from its lower surface 47 to its top surface 48 with a countersunk portion (not shown) formed at lower surface 47. In other preferred embodiments, the pin bore may extend only partially into slider block 26 from lower surface 47 a distance sufficient to receive eccentric pin 34, with lubricant passages provided to the top and/or sides of the slider block.

In operation, motor 30 rotatably drives crankshaft 32 and thus, eccentric pin 34. Flat drive surface 33 on eccentric pin 34 engages flat driven surface 31 to rotate slider block 26, shown in FIG. 2, thereby driving orbiting scroll 16 via slider block 26 and bushing 27. A rotation prevention mechanism, such as Oldham coupling 36, is positioned between crankcase 8 and orbiting scroll 16, or between fixed scroll 10 and orbiting scroll 16, to prevent rotation of orbiting scroll 16 as it undergoes such orbital motion. Oldham couplings and their operation are well understood by those skilled in the art and, therefore, no further description need be provided here. A fluid, typically refrigerant, is introduced into a low pressure area of pockets 20, typically proximate an outer edge of spiral wraps 12, 18. As orbiting scroll 16 orbits, pockets 20 travel spirally inward with progressively decreasing volume, thus compressing the fluid in pockets 20. The compressed fluid is discharged from a high pressure area of pockets 20, typically in a central portion thereof, through discharge port 15 into muffler chamber 40 via check valve 38, located on discharge surface 41 of fixed scroll 10. The compressed fluid is then discharged from muffler chamber 40 via outlet 42, which extends through an outer surface of top cap 6.

Oil, shown by dashed lines 44, is fed upwardly through passageway 35 from a reservoir (not shown) as crankshaft 32 rotates. Oil 44 reaches top surface 46 of eccentric pin 34 and is thrown outwardly by centrifugal forces. Oil 44 travels across top surfaces 46, 48 of eccentric pin 34 and slider block 26, respectively, and then downwardly on outer surface 52 of slider block 26, the surface of bushing 27, and the surface 55 of eccentric pin 34. Oil 44 then drains back to the reservoir, completing the lubrication cycle of these bearing surfaces. In certain preferred embodiments, an axial nub (not shown) extends upwardly from the top surface of the slider block to maintain a gap above the slider block which allows the oil to flow freely across the entire top surface of the slider block.

In another preferred embodiment, shown in FIG. 3 in enlarged cross-section view, partially broken away, a crankcase mating surface such as rabbet 60 is formed along an outer peripheral area of fixed scroll 10. A correspondingly figured scroll mating surface, such as ridge 62, is formed along the outer peripheral area of riser 23 of crankcase 8. Outer peripheral area, as used here, refers to the radially outermost region or area of crankcase 8 and/or fixed scroll 10. Scroll mating surface and crankcase mating surface, as used here, refer to two cooperating surfaces, e.g. a projection and mating recess, which matingly engage one another to align crankcase 8 and fixed scroll 10 within compressor 2. Matingly engage, as used here, refers to two members which are in a positive locking or fixed relationship with respect to one another, e.g. being radially fixed with respect to one another. Such fixed relationship can be realized by corresponding surface irregularities formed in the members which are matingly engaged, e.g. a projection which is received by a recess. In the illustrated embodiment, rabbet 60 and ridge 62 extend circumferentially along crankcase 8 and fixed scroll 10, respectively, and cooperate to radially align fixed scroll 10 and crankcase 8, facilitating their assembly within compressor 2. Radially aligned, as used here, refers to two members, e.g. fixed scroll 10 and crankcase 8, which are prevented from moving with respect to one another in a radial direction. Radial alignment thus serves to properly align fixed scroll 10 and crankcase 8 within center shell 4 and top cap 6.

Figure 4:
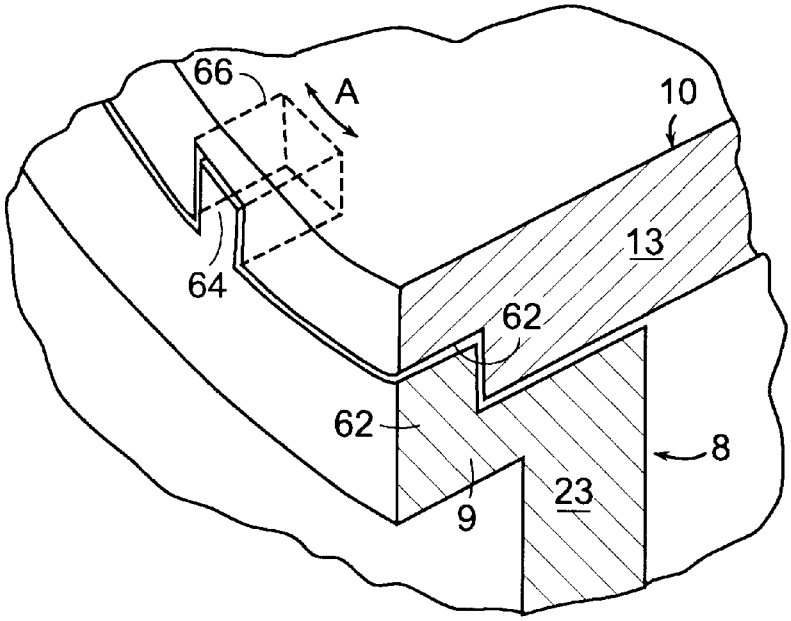
FIG. 4 is a schematic close-up perspective view, shown partially in section and partially broken away, of an alternative embodiment of the rabbet and ridge of FIG. 3.

In another preferred embodiment, seen in FIG. 4, ridge 62 has an aligning surface or projection 64 formed thereon and rabbet 60 has a mating aligned surface or recess 66 formed therein. Aligning surface and aligned surface, when used here, refer to two cooperating surfaces or surface irregularities on the scroll mating surface and crankcase mating surface, e.g. a projection and mating recess, which matingly engage one another to angularly align crankcase 8 and fixed scroll 10 with respect to one another. In the illustrated embodiment, projection 64 extends axially upwardly from ridge 62 of crankcase 8, mating with recess 66, shown in dashed lines, formed in fixed scroll 10. Recess 66 and projection 64 preferably extend radially inwardly along fixed scroll 10 and crankcase 8, respectively. The cooperative engagement of projection 64 and recess 66 provides angular alignment of crankcase 8 and fixed scroll 10. Angular alignment, as used here, refers to two members, e.g. crankcase 8 and fixed scroll 10, being prevented from rotating with respect to one another about their respective axes of rotation. Thus, in the illustrated embodiment, crankcase 8 and fixed scroll 10 are fixed from rotating with respect to one another in the directions shown by arrow A via the interaction of projection 64 and recess 66. In other preferred embodiments, the angular alignment of crankcase 8 and fixed scroll 10 may be provided directly by the crankcase mating surface and the fixed scroll mating surface, e.g. an irregular shaped rabbet 60 and a mating irregular shaped ridge 62.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

We claim:

1. A scroll machine comprising, in combination:

a housing having a first member having an end surface at an end defining an opening, and a second member secured to the first member;

a crankcase positioned within the housing;

an orbiting scroll having a base plate and a spiral wrap extending axially from the orbiting scroll base plate; and a fixed scroll having a base plate, a spiral wrap extending axially from the fixed scroll base plate and nested with the spiral wrap of the orbiting scroll, and a discharge port, the fixed scroll being pinned between the second member and one of the crankcase and the first member, said second member having a radially outwardly extending portion operatively holding said fixed scroll against said one of said crankcase and said first member, said second member being secured to a radially outward surface of said first member.

2. The scroll machine according to claim 1, further comprising a radially outwardly extending flange on one of the crankcase and the fixed scroll, supported by the end surface of the first member.

3. The scroll machine according to claim 2, wherein the flange is on the crankcase, and the fixed scroll is pinned between the second member and the crankcase.

4. The scroll machine according to claim 3, wherein the second member is a top cap.

5. The scroll machine according to claim 3, wherein the fixed scroll and crankcase are held in direct contact with one another free of fasteners.

6. The scroll machine according to claim 2, wherein the flange extends circumferentially substantially completely around the one of the crankcase and the fixed scroll.

7. The scroll machine according to claim 2, wherein the flange is unitary with the one of the crankcase and the fixed scroll.

8. The scroll machine according to claim 1, wherein the housing is substantially cylindrical.

9. The scroll machine according to claim 1, wherein the first member comprises a center shell and the second member comprises a top cap, the top cap closing the opening, pressing on the fixed scroll and being secured to the center shell to pin the fixed scroll between the top cap and either the crankcase or the center shell;

further comprising a fixed scroll seal sealingly engaging a surface of the fixed scroll and an inside surface of the top cap to form a muffler chamber in fluid communication with the discharge port of the fixed scroll.

10. The scroll machine according to claim 9, wherein the surface of the fixed scroll is a discharge surface of the fixed scroll.

11. The scroll machine according to claim 9, wherein the surface of the fixed scroll is an upper surface of the fixed scroll.

12. The scroll machine according to claim 9, wherein the muffler chamber is formed as a raised central portion of the top cap.

13. The scroll machine according to claim 9, wherein the fixed scroll seal comprises a resilient member positioned between the fixed scroll and an inside surface of the top cap.

14. The scroll machine according to claim 13, wherein the resilient member comprises an O-ring.

15. The scroll machine according to claim 13, wherein the resilient member is seated in a recess formed in one of said surface of the fixed scroll and inside surface of the top cap.

16. The scroll machine according to claim 15, wherein the recess comprises an annular groove formed in an upper surface of the fixed scroll.

17. The scroll machine in accordance with claim 9, wherein an inner surface of the top cap is secured to an outer surface of the housing.

18. The scroll machine in accordance with claim 9, further comprising a check valve on the fixed scroll, communicating with the discharge port and exhausting into the muffler chamber.

19. The scroll machine according to claim 1, wherein a crankcase mating surface on the fixed scroll matingly engages a scroll mating surface on the crankcase to fixedly align the fixed scroll and the crankcase.

20. The scroll machine according to claim 19, wherein the fixed scroll and the crankcase have a fixed angular alignment to each other, to prevent rotation of one with respect to the other.

21. The scroll machine according to claim 20, wherein the fixed scroll and the crankcase have correspondingly radially extending surface irregularities.

22. The scroll machine according to claim 19, wherein the fixed scroll and the crankcase have a fixed radial alignment to each other.

23. The scroll machine according to claim 22, wherein the fixed scroll and the crankcase have correspondingly circumferentially extending surface irregularities.

24. The scroll machine according to claim 19, wherein the fixed scroll and the crankcase are angularly and radially fixedly aligned.

25. The scroll machine according to claim 19, wherein the crankcase mating surface comprises a rabbet formed on a radially outer peripheral area of the fixed scroll.

26. The scroll machine according to claim 25, wherein the scroll mating surface comprises a ridge formed on a radially outer peripheral area of the crankcase which matingly engages the rabbet on the fixed scroll to fixedly radially align the fixed scroll and the crankcase.

27. The scroll machine according to claim 26, further comprising a projection formed on one of the crankcase and the fixed scroll, and a recess formed on the other of the crankcase and the fixed scroll, the projection and the recess matingly engaging one another to angularly fixedly align the crankcase and the fixed scroll.

28. The scroll machine according to claim 1, wherein the crankcase has a primary bearing surface supporting the orbiting scroll and a circumferential riser radially outward of the primary bearing surface and extending axially above the orbiting scroll base plate providing a support surface for the fixed scroll.

29. The scroll machine according to claim 28, wherein the riser extends substantially to the height of the fixed scroll spiral wrap.

30. The scroll machine according to claim 28, further comprising a radially outwardly extending flange on the riser supported by the end surface of the first member.

31. The scroll machine according to claim 28, wherein the crankcase has a primary bearing surface supporting the orbiting scroll and a plurality of circumferential risers radially outward of the primary bearing surface and extending axially above the orbiting scroll base plate providing a support surface for the fixed scroll.

32. The scroll machine according to claim 28, wherein the riser is unitary with the crankcase.

33. A scroll machine comprising, in combination:

a housing having a center shell with an end surface at an end defining an opening, and a top cap secured to the center shell to close the opening;

a crankcase having a scroll mating surface, a primary bearing surface supporting the orbiting scroll, and a circumferential riser radially outward of the primary bearing surface and extending axially above the orbiting scroll base plate;

an orbiting scroll having a base plate and a spiral wrap extending axially from the orbiting scroll base plate;

a fixed scroll pinned between the top cap and one of the center shell and the crankcase, having a base plate, said top cap having a radially outwardly extending portion operatively pinning said fixed scroll to the one of the center shell and the crankcase, and said top cap then being secured to a radially outer peripheral surface of the center shell, a spiral wrap extending axially from the fixed scroll base plate and nested with the spiral wrap of the orbiting scroll, a discharge port, and a crankcase mating surface, the scroll mating surface matingly engaging the crankcase mating surface to fixedly align the fixed scroll and the crankcase; and a fixed scroll seal sealingly engaging a surface of the fixed scroll and an inside surface of the top cap forming a muffler chamber in fluid communication with the discharge port of the fixed scroll.

34. The scroll machine according to claim 33, further comprising a radially outwardly extending flange on one of the crankcase and the fixed scroll.

35. The scroll machine according to claim 34, wherein the flange is on the crankcase and supported by the end surface of the center shell, and the fixed scroll is pinned between the top cap and the crankcase.

36. The scroll machine according to claim 33, wherein the fixed scroll seal comprises a resilient member positioned between the fixed scroll and an inside surface of the top cap.

37. The scroll machine according to claim 36 wherein the resilient member comprises an O-ring.

38. The scroll machine according to claim 36, wherein the resilient member is seated in a recess formed in one of said surface of the fixed scroll and inside surface of the top cap.

39. The scroll machine according to claim 38, wherein the recess is an annular groove formed in an upper surface of the fixed scroll.

40. The scroll machine according to claim 33, wherein a crankcase mating surface on the fixed scroll matingly engages a scroll mating surface on the crankcase to fixedly align the fixed scroll and the crankcase.

41. The scroll machine according to claim 40, wherein the fixed scroll and the crankcase have a fixed angular alignment to each other, to prevent rotation of one with respect to the other.

42. The scroll machine according to claim 40, wherein the fixed scroll and the crankcase have a fixed radial alignment to each other.

43. The scroll machine according to claim 40, wherein the fixed scroll and the crankcase are angularly and radially fixedly aligned.

44. A boltless scroll machine comprising, in combination:

a housing having a first member with an end surface defining an opening, and a second member secured to the first member;

a crankcase positioned within the housing;

an orbiting scroll having a base plate and a spiral wrap extending axially upwardly from the orbiting scroll base plate;

a fixed scroll having a base plate, a spiral wrap extending axially downwardly from the fixed scroll base plate, and nested with the spiral wrap of the orbiting scroll, and a discharge port, the fixed scroll and crankcase being pinned between the second member and the first member, the second member having a radially outwardly extending portion operatively pinning the fixed scroll between the second member and the first member, and the second member being secured to an outer peripheral surface of the first member; and a radially outwardly extending flange on one of the fixed scroll and the crankcase.

45. A scroll machine comprising, in combination:

a housing having a center shell with an end surface at an end defining an opening, and a top cap secured to the center shell to close the opening;

a crankcase having a scroll mating surface; a primary bearing surface supporting the orbiting scroll, a riser radially outward of the primary bearing surface and extending axially above the orbiting scroll base plate, and a radially outwardly extending flange, the flange being supported by the end surface of the center shell;

an orbiting scroll having a base plate and a spiral wrap extending axially from the orbiting scroll base plate;

a fixed scroll pinned between the top cap and the crankcase, the top cap having a radially outwardly extending portion operatively pinning the fixed scroll between the top cap and the crankcase, and the top cap being secured to an outer peripheral surface of the center shell.

* * * * *